United States Patent [19]

Yamaguchi et al.

[11] Patent Number: 5,050,522

[45] Date of Patent: Sep. 24, 1991

[54] APPARATUS FOR CONNECTING A PUSHER BOAT AND A BARGE

[76] Inventors: Takuma Yamaguchi, 1-308, No. 10, 3-chome, Natsumidai, Funabashi-shi, Chiba-ken, Japan, 273; Kiyoshi Mogami, Odakyuhaitsu 11-304, No. 5-16, 2-chome, Fujimidai, Nagareyama-shi, Chiba-ken, Japan, 270-01

[21] Appl. No.: 571,097

[22] Filed: Aug. 21, 1990

[30] Foreign Application Priority Data

Sep. 1, 1989 [JP] Japan ..... 1-101773[U]

[51] Int. Cl.[5] ..... B63B 21/56

[52] U.S. Cl. ..... 114/249; 114/248

[58] Field of Search ..... 114/248, 249, 250, 251, 114/252

[56] References Cited

U.S. PATENT DOCUMENTS

| | | | |
|---|---|---|---|
| 3,512,495 | 5/1970 | Fletcher | 114/249 |
| 3,837,315 | 9/1974 | Giblon | 114/248 |
| 3,844,245 | 10/1974 | Yamaguchi . | |
| 3,910,219 | 10/1975 | Ono et al. | 114/248 |
| 3,935,831 | 2/1976 | Yamaguchi . | |
| 4,805,548 | 2/1989 | Yamaguchi . | |

FOREIGN PATENT DOCUMENTS

| | | | |
|---|---|---|---|
| 275087 | 12/1986 | Japan | 114/248 |

*Primary Examiner*—Sherman Basinger
*Assistant Examiner*—Thomas J. Brahan
*Attorney, Agent, or Firm*—Wenderoth, Lind & Ponack

[57] ABSTRACT

An apparatus is disclosed for connecting a pusher boat and a barge, having a notch in the stern portion for receiving the hull of the pusher boat, such that a three-point supported rigid connection is formed which utilizes three axially movable connecting pins. One of the pins is mounted at the bow end of the pusher boat to form a multi-step tooth-engagement with a centerline pin-end receiving member consisting of concavities arranged along the barge's centerline at the deepest point of the notch. The other two pins are mounted on opposing sides of the pusher boat to form a combined friction- and multi-step tooth-engagement with side-pin-end receiving members defined by vertical slots, in the side walls of the notch, with concavities arranged along the centerlines of the slots' base surfaces. This is accomplished with the aid of pressing shoes which are slidably mounted on the outer end portions of the side connecting pins so that they can be pressed into the slots to realize simultaneous forced contact between the forward and rearward faces of the pressing shoes and corresponding side walls of the slots. In this way the pusher boat and the barge are so firmly connected with each other that a superior seaworthiness can be assured even in rough ocean waves.

23 Claims, 4 Drawing Sheets

APPARATUS FOR CONNECTING A PUSHER BOAT AND A BARGE

BACKGROUND OF THE INVENTION

The present invention relates to a means of connecting a pusher boat and a barge.

Barges are widely employed for the transport of cargoes in rivers, canals and lakes, and even in open sea. There are two conventional methods to move the barges, one being to tow by a towboat and the other being to push by a pusher boat. The present invention relates to the latter case where the barge is connected with the pusher boat to form a pusher-barge combination system. More particularly, the invention relates to a means of connecting a pusher boat and a barge to form an improved pusher-barge combination system with excellent performance.

The methods of connecting a pusher boat and a barge are classified broadly into the following three categories:

(a) Rope-connection;

(b) Articulate mechanical connection by a pair of transverse horizontal co-axial connecting pins to permit relative pitching of the pusher boat and the barge; and (c) Rigid mechanical connection permitting no relative motions of the pusher boat and the barge.

Though widely employed even now, the rope-connection under (a) above results in such a poor navigability in waves that any safe and steady services in wavy sea cannot be expected.

The articulate mechanical connection methods under (b) above are well-developed now, particularly by the aid of the connecting means invented by the present applicant and patented in the United States under U.S. Pat. No. 3,844,245 (corresponding U.K. Pat. No. 1,386,185 and German Federal Republic Pat. No. 2,303,818), U.S. Pat. No. 3,935,831 (corresponding Canadian Pat. No. 1,026,164, French Pat. No. 75/11118, German Federal Republic Pat. No. 2,516,372 and U.K. Pat. No. 1,465,207) and U.S. Pat. No. 4,805,548 (corresponding U.K. Pat. No. 2,108,436). These three inventions have been so successful that the performance of pusher-barge combinations systems has been remarkably improved up to the level assuring safe and steady navigations in the rough ocean areas.

In spite of such a good performance in regard to the navigability in rough sea, the articulate connection methods as per (b) above have two demerits, one being the wide clearance between two hulls for permitting free relative pitching which causes such heavy eddies that the running speed is lowered and the other being the lack of comfortableness to the crew on board the heavily pitching pusher boat swung by the barge.

These demerits can be overcome by the rigid connection methods under (c) above which do not permit any relative motion of two watercraft and, accordingly, permit reduction of the clearance between the hulls to a minimum to improve the propulsive performance and, at the same time, assure a superior seaworthiness and comfortableness in rough sea. The apparatus for connecting a pusher boat and a barge according to the present invention belongs to this category (c) above—rigid mechanical connection method.

In the earlier stage, rigid mechanical connection methods of several types were invented mainly in the United States. These methods proposed in earlier days have a common design principle that the stern of the barge is made in a special shape and the bow or the whole hull of the pusher boat is inserted into or land on this specially shaped stern portion of the barge. According to such designs, connection and disconnection can take place only when both the pusher boat and the barge are approximately in the fully loaded condition. Such connection systems have practically no self-adaptability to the change of draft of the barge due to loading and unloading and, further, if the draft of the barge changes widely due to collision and subsequent flooding, emergency disconnection of the pusher boat would become impossible.

As a rigid connection method permitting self-adaptation to the change of draft of the barge, the present applicant has an invention as per Japanese Patent Journal No. S51-40352 and there is another as per Japanese Utility Model Journal No. S52-38000 which is generally similar to the former. (These two are hereinafter referred to as the "former inventions"). The basic design principle of these is that the pusher boat is equipped with three connecting pins—one pin at the bow end and two pins on both sides of the pusher boat—which are extended out axially so that their outer ends may be inserted into holes, in the wall of the stern notch of the barge, functioning as pin-end supporting means on the barge, to form a rigid connection through supporting the pusher boat at three points. If the pin-end supporting means on the barge hull are arranged vertically in two or more steps, connection can take place in two or more draft relationships. Further, prompt disconnection can take place simply by retracting the connecting pins in such an emergency case as is mentioned above.

Though the above-mentioned former inventions can meet the minimum necessary conditions of rigid connection, they involve some difficulties and inconveniences particularly in the course of connection, because the pin-end receiving means are simple holes and, particularly when the pusher boat and the barge are oscillating due to waves, it is very difficult to insert pins into them. Further, even when these holes are provided in plurality, two or three holes can be arranged in practice because of their large dimensions and, if the draft relationship is such that the pins are at a level between two vertically arranged holes, the draft must be adjusted through adding a big quantity of water ballast. In addition, the pusher boat must be kept disconnected during loading and unloading. The present invention is proposed in order to solve these problems involved in the connecting means of the former inventions.

SUMMARY OF THE INVENTION

The principal objective of the present invention is to provide, without sacrificing the high seaworthiness and high propulsive performance, and also good comfortableness to the crew, realizable by the connecting means of the former inventions, an improved means of connecting a pusher boat and a barge in which connection work is commenced with friction-engagement by means of side connecting pins to ease its first stage under the influence of waves so that large relative motions of the pusher boat and the barge may be stopped, and then, this friction-connection is slightly loosened to change to multi-step tooth-engagement and, immediately after, tight friction engagement is recovered to form a combined friction- and tooth-engagement. Then, the bow connecting pin is actuated to form a multi-step tooth-engagement at the bow so that a three-point supported rigid connection can be realized to assure an excellent seaworthiness. In addition, the utilization of friction-engagement in the connecting means of the present invention enables self-adaptation to the change of draft of the barge due to loading and unloading.

Pursuant to the above-mentioned objective of the invention, the means of connecting a pusher boat and a barge for realizing three-point supported rigid connection between the barge, having a notch at its stern for receiving the pusher boat from its bow, and a pusher boat, having two transversely extendable and retractable side connecting pins and a longitudinally extendable and retractable bow connecting pin by the aid of hydraulic cylinders or other power actuating means, is constructed as stated hereinafter. That is, each side wall of the notch has a vertically extending slot open toward the inside of said notch and having an approximately trapezoidal cross-section which is widest at its entrance and narrows toward an inner base surface of the slot. The slots are each provided with side concavities having substantially equal cross sectional shape, respectively, which open toward said notch and are stepwise arranged at an approximate equidistance apart from the upper part to the lower part on and along the bottom wall of said slot. The combination of said slot and said concavities forms the pin-end receiving means on each side wall of said notch.

The outer end portion of each of the side connecting pins is formed as a projection with an approximately wedge-shaped tip which can engage into any of said side concavities and, in addition, carries a pressing shoe slidably mounted thereon and shaped to be inserted into said slot so that it may be pressed onto the oblique forward and rearward side walls of said slot. In addition, the pressing shoe has a hole in its outer face through which the tip of said projection can project beyond the outer face.

At the deepest point of said notch, there is a centerline pin-receiving means consisting of concavities arranged at an approximate equidistance apart from the upper part to the lower part along the barge's centerline so that any of these concavities can receive and engage with the approximately wedge-shaped tip at the outer end of the bow connecting pin when it is extended out.

DETAILED DESCRIPTION OF THE PREFERRED EMBODIMENT

Figure 1:
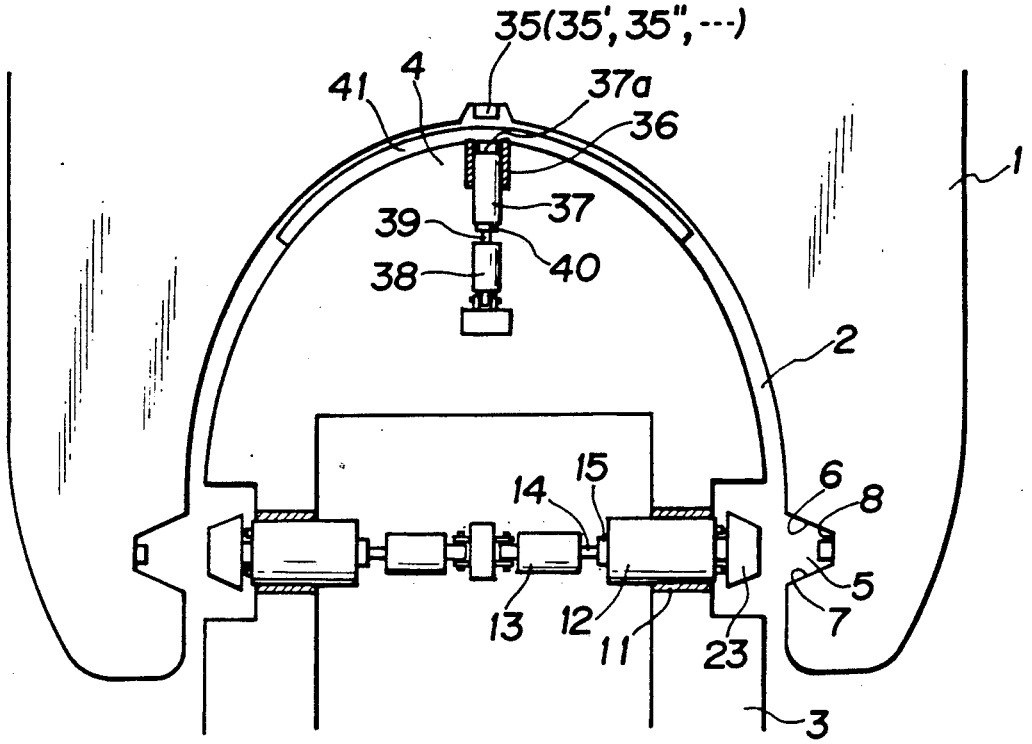
FIG. 1 is a partial cross-sectional plan view of an embodiment of the present invention before connection.

Referring to FIGS. 1 to 10, the barge 1 is provided with a notch or well 2 at its stern portion for receiving the hull of the pusher boat 3 from its bow 4. The configuration and size of the notch 2 is such that, when the pusher boat 3 is connected to the barge 1, a proper clearance may be left between the hull of the pusher boat 3 and the wall of the notch 2 of the barge 1. Each side of the notch 2 is provided with a vertically extending slot 5 open toward the inside of the notch 2 and having approximately a trapezoidal cross-section which is widest at its entrance and narrows toward an inner base surface of the slot. The slot 5 is formed of an oblique forward side wall 6 and an oblique rearward side wall 7, corresponding to the fore and stern of said barge 1, respectively, and, in addition, a bottom wall 8 connecting the forward and rearward side walls 6 and 7. The bottom wall 8 is provided with side concavities 9, 9', 9'', . . . which have a substantially equal shapes in as viewed vertical cross-section and which open toward said notch 2 and are stepwise arranged approximately at an equidistance apart from the upper part to the lower part along the centerline of the bottom wall 8. Between these side concavities 9, 9', 9'', . . . , side convexities 10, 10', 10'', . . . are formed. The vertical slot 5 having a forward side wall 6, a rearward side wall 7 and a bottom wall 8 with a series of side concavities 9, 9', 9'', . . . forms a side pin-end receiving means constructed as a combined press-on and tooth-engagement portion for receiving and supporting, by any one of the side concavities 9, 9', 9'', . . . , the end tip extruded from the outer end of the connecting pin to be described later and, in addition, receiving a pressing shoe to be described later, mounted at the end of the same connecting pin, so that its forward and rearward faces may be pressed onto the forward and rearward side walls 6 and 7, respectively. Each side of the pusher boat 3 is provided with a cylindrical side connecting pin 12 which is supported by and slides along a long bearing 11 transversely and horizontally placed symmetrically with respect to the ship's centerline and fixed to the hull. The inboard end of said side connecting pin 12 is connected with the power transmitting piece of a hydraulic power means installed on the hull of said pusher boat 3, such as a piston rod 14 of a main hydraulic cylinder 13, by means of a proper coupling member 15 which permits free relative rotational motion. The side connecting pin 12, together with the pressing shoe, etc. mounted thereon which will be described later, is extended out and retracted in by the function of said main hydraulic cylinder 13 to be energized by pressure fluid supplied by the hydraulic power source (not shown in drawings) on board. After the outward motion of the side connecting pin 12 has been stopped the outward force of the hydraulic cylinder 13 is maintained by fluid pressure supplied through a non-return valve (not shown in drawings) from a pump, a pressure accumulator or the like (not shown in drawings). Thus, the side connecting pin 12 is forced to remain at its extended position, and the non-return valve will prevent inward motion of the side connecting pin 12 subjected to large external force which, otherwise, would push back said side connecting pin 12 and loosen the connection. Besides the hydraulic power means, such as the main hydraulic cylinder 13, the side connecting pin 12 can be extended and retracted by a power actuating means of any other type, such as a combination of a rotating motor and a screw-threaded rod or the like.

The outer end of said side connecting pin 12 is shaped as a projection 18 having a large vertical dimension, and the pressing shoe 23 having a long vertical length is pivotally and slidably mounted on the projection 18 by means of the horizontal pins 21 and 22. The pressing shoe 23 has an approximately trapezoidal shape in its horizontal cross-section corresponding to the horizontal cross-section of the vertical slot 5. The ends of the pins 21 and 22 are inserted into the long grooves 24*a* and 24*b*, respectively, on the side surfaces of the projection 18 so that the pins 21 and 22 can slide along the grooves 24*a* and 24*b*, respectively. The pressing shoe 23 can be pushed out by piston rods 17*a* and 17*b* of two hydraulic sub-cylinders 16*a* and 16*b*, respectively, incorporated in the side connecting pin 12. When the pressing shoe 23 is fully pushed out and, in addition, the side connecting pin 12 is pushed out by the function of the main hydraulic cylinder 13 so that the pressing shoe 23 may be pushed into the slot 5, the oblique forward and rearward faces 26 and 27 of the pressing shoe 23 are brought into simultaneous contact with and pressed onto the forward and rearward side walls 6 and 7 of the slot 5, respectively. These components are so dimensioned that the outer face 28 of the pressing shoe 23 will not come into contact with the side convexities 10, 10', 10'', . . . even when the pressing shoe 23 is fully pressed into the slot 5. Further, when the pressing shoe 23 is fully pushed out by the function of the sub-cylinders 16*a* and 16*b*, a tip 19 at the outer end of the projection 18 will not project beyond the outer face 28 of the pressing shoe 23. The outer face 28 has a hole 25 through which the tip 19 can project beyond the outer face 28. Further, the oblique forward and rearward faces 26 and 27 of the pressing shoe 23 have high-friction linings 29 and 30, respectively, such as hard rubber or the like.

Figure 9:
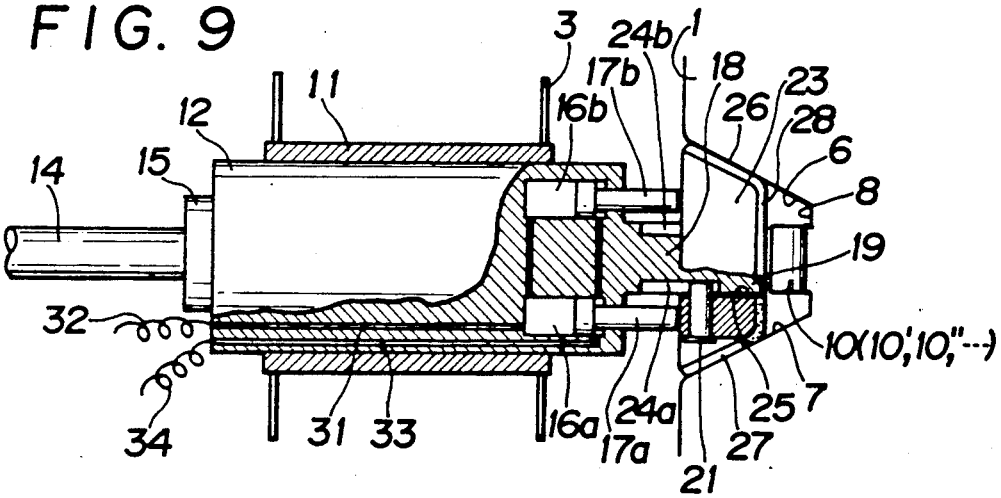
FIG. 9 is a partial cross-sectional plan view of said side connecting pin assembly at a stage of connection utilizing only friction-engagement.
Figure 10:
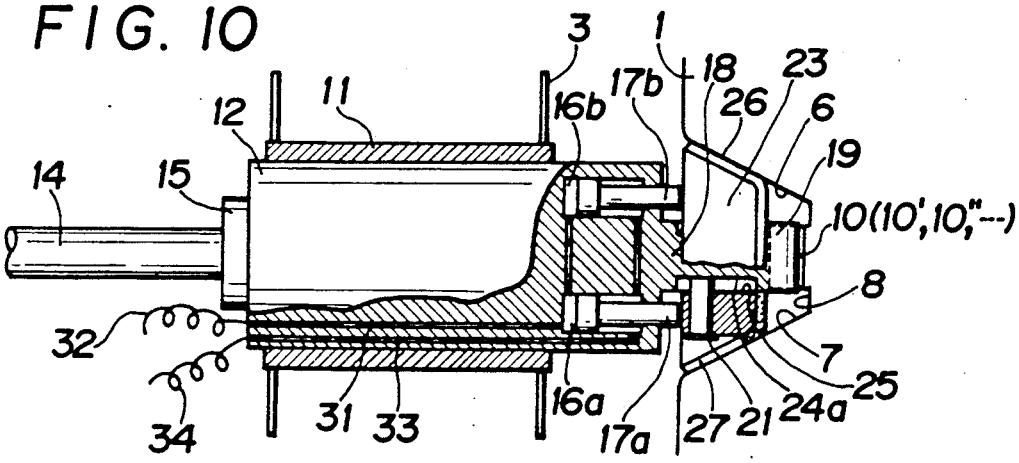
FIG. 10 is a partial cross-sectional plan view of said side connecting pin assembly at a final stage of connection utilizing both friction- and tooth-engagement.

When the pressing shoe 23 is pushed out by the function of the hydraulic sub-cylinders 16*a* and 16*b* and, then, the side connecting pin 12 is extended out by the function of the main hydraulic cylinder 13 so that the oblique forward and rearward faces 26 and 27 are pressed onto the forward and rearward side walls 6 and 7, respectively (as shown in FIG. 9), the outer face 28 does not come into contact with any part of the bottom of the slot 5 and, accordingly, strong friction force is caused between the slot 5 and the pressing shoe 23 by the wedge effect and the high friction coefficient of the linings 29 and 30. By keeping the outward force pushing the side connecting pin 12 and the pressing shoe 23, a friction-engagement connection can be formed which will prevent the pressing shoe 23 from slipping vertically in the slot under influence of waves of a certain height. After formation of this friction-engagement connection, the hydraulic pressure in the head-side of the sub-cylinders 16*a* and 16*b* is released and, at the same time, pressure fluid is supplied to the head-side of the main hydraulic cylinder 13 so that the side connecting pin 12 is further extended and the approximately wedge-shaped tip 19, at the outer end of the projection 18, shaped to engage tightly with any of the concavities 9, 9', 9'', . . . , engages into one of side concavities 9, 9', 9'', . . . located at the same height as the tip 19 (see FIG. 10). At this stage, the pressing shoe 23 is moved back as the pins 21 and 22 slide along the grooves 24*a* and 24*b*, respectively. Immediately after the tip 19 has engaged into one of the side concavities 9, 9', 9'', . . . , the piston rods 17*a* and 17*b* are pushed out by supplying pressure fluid into the head-sides of the sub-cylinders 16*a* and 16*b* in order to insert the pressing shoe 23 into the slot 5 again. Thus, the connection by means of the side connecting pin 12 is finished. For pushing the pressing shoe 23 outwardly, a power actuating means of another type, such as a combination of a rotating motor and a screw-threaded rod or the like, can be used instead of the above-mentioned hydraulic sub-cylinders 16*a* and 16*b*. The head-side and rod-side spaces of the hydraulic sub-cylinders 16*a* and 16*b* are connected with the hydraulic power source (not shown in drawings) by the pipes 31 and 33 and the high-pressure flexible hoses 32 and 34, respectively, so that the sub-cylinders 16*a* and 16*b* can be actuated by this power source to push the pressing shoe 23 outwardly.

At the deepest point of the notch 2 of the barge 1, centerline concavities 35, 35', 35'', . . . having substantially equal cross-sections opening toward said notch are stepwise arranged from the upper part to the lower part along the centerline of the barge, in a similar manner as the side concavities, to function as a centerline pin-end receiving means. On the other hand, the pusher boat 3 has, at its bow 4, a cylindrical bow connecting pin 37 which is supported by and slides in a bearing 36 longitudinally and horizontally. The inboard end of the bow connecting pin 37 is connected with a power transmitting piece of a hydraulic power means installed on the hull of said pusher boat 3, such as the piston rod 39 of a bow hydraulic cylinder 38, by means of a proper coupling member 40 which permits free relative rotational motion. The bow connecting pin 37 is extended out and retracted in by the function of said bow hydraulic cylinder 38 which can be energized by pressure fluid supplied by the hydraulic power source (not shown in drawings) on board. After the outward motion of the bow connecting pin 37 has been stopped, the outward force of the hydraulic cylinder 38 is maintained by fluid pressure from a pump, a pressure accumulator or the like (not shown in drawings). Besides the hydraulic power means, such as the bow hydraulic cylinder 38, the bow connecting pin 37 can be extended and retracted by a power actuating means of any other type, such as a combination of a rotating motor and a screw-threaded rod or the like.

The outer end of the bow connecting pin 37 is an approximately wedge-shaped tip 37*a* which can tightly engage with anyone of the centerline concavities 35, 35', 35'', . . . which is at the same height as the tip 37*a*, when the bow connecting pin 37 is extended out. When this occurs thus, the connection by means of the bow connecting pin 37 is finished and the three-point supported rigid connection of the pusher boat 3 and the barge 1 is established as a result of the combined functions of the bow connecting pin 37 and the two side connecting pins 12.

Figure 2:
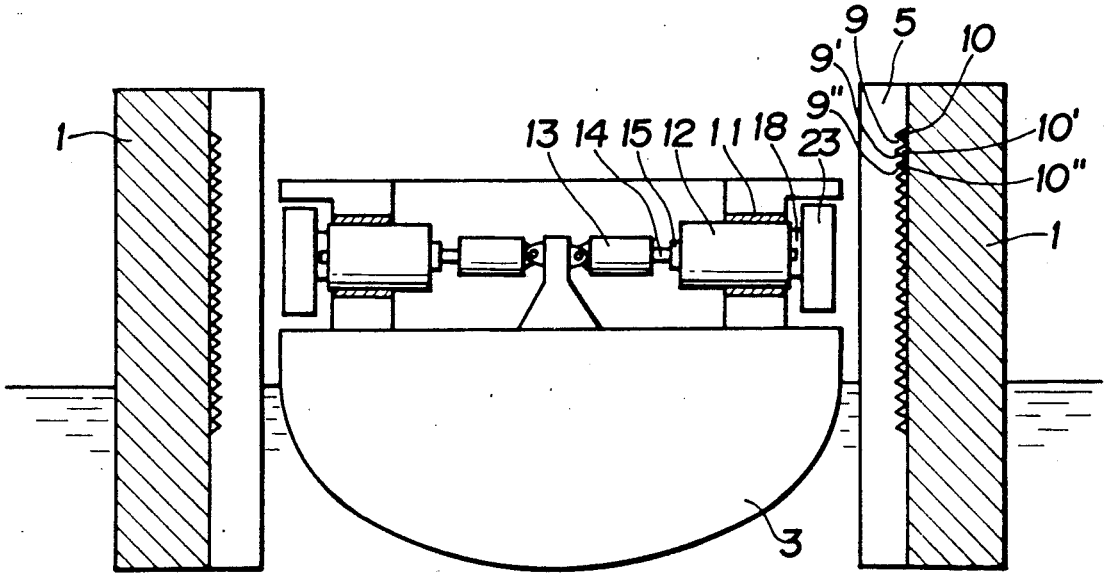
FIG. 2 is a cross-sectional elevational view of an embodiment of the present invention before connection.
Figure 3:
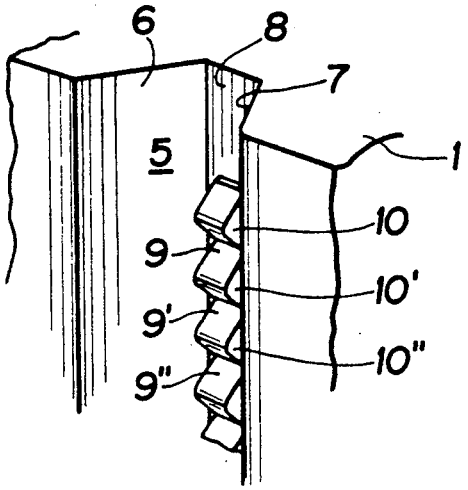
FIG. 3 is a partial perspective view of the slot and the side concavities of the present invention.
Figure 4:
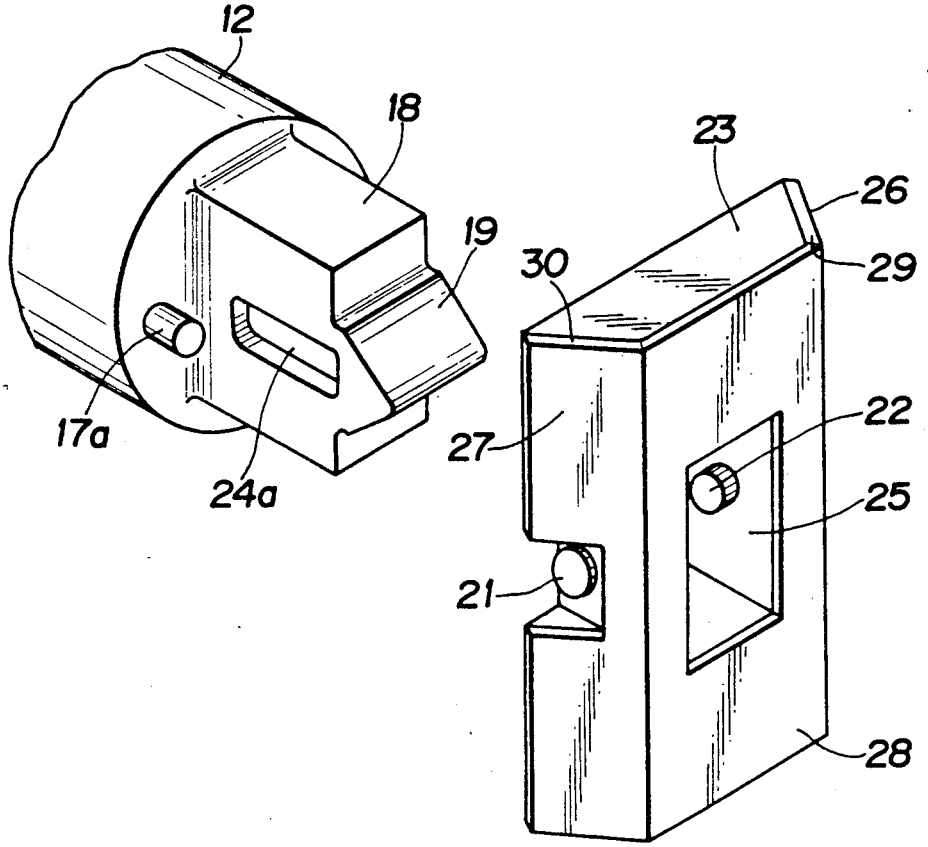
FIG. 4 is a partial perspective view of the outer end portion of the side connecting pin and the pressing shoe dismantled therefrom, according to the present invention.
Figure 5:
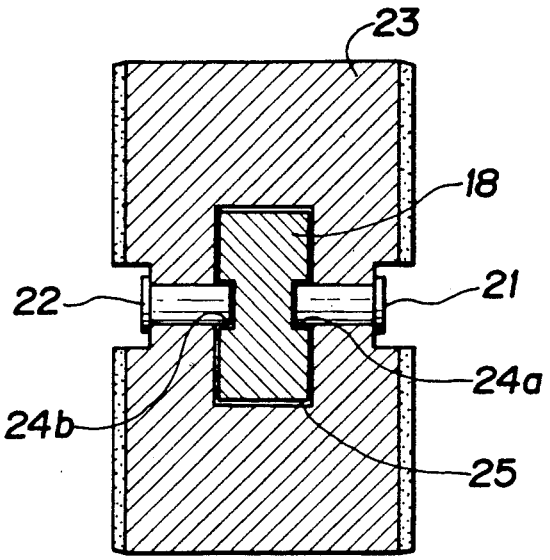
FIG. 5 is a cross-sectional elevational view of said pressing shoe through a vertical plane passing the centerlines of the pins pivotally supporting said pressing shoe.
Figure 7:
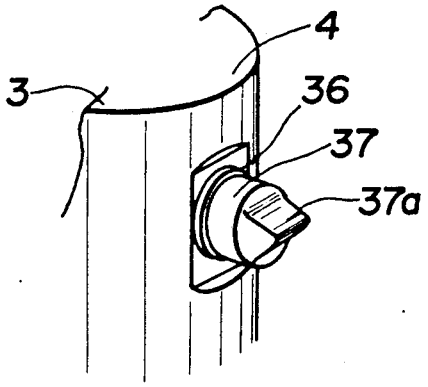
FIG. 7 is a partial perspective view of the bow connecting pin of the present invention.
Figure 6:
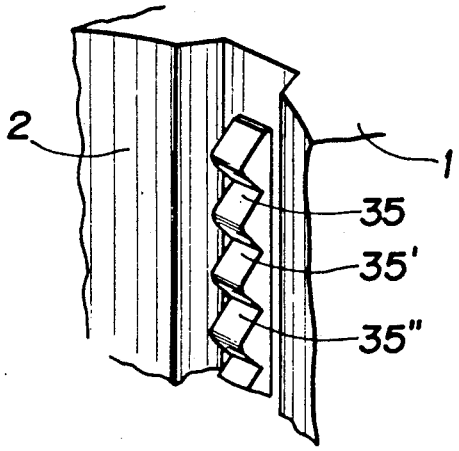
FIG. 6 is a partial perspective view of the centerline concavities.
Figure 8:
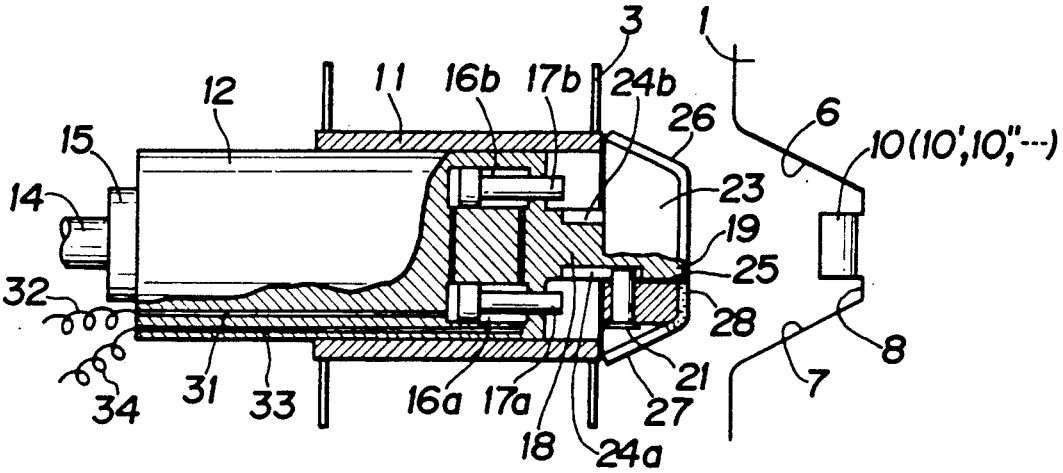
FIG. 8 is a partial cross-sectional plan view of a side connecting pin assembly of the present invention before connection.

Next, the functions and operation of the connecting means according to the embodiment described above will be explained. Before connection, the side connecting pins 12 are retracted in the bearings 11 and the bow connecting pin 37 is retracted in the bearing 36 as shown in FIGS. 1 and 2, or, in other words, they are retracted in the hull of the pusher boat 3. The bow 4 of the pusher boat 3 is ordinarily provided with a soft fender 41 so dimensioned that, when the bow 4 of the pusher boat 3 is inserted into the notch 2 of the barge 1 and, at the last stage, the fender 41 comes into contact with the deepest point of the notch 2, the forward edge of the outer face 28 of the pressing shoe 23, is located slightly abaft of the entrance end of the forward side wall 6 of the slot 5. Then, the hydraulic sub-cylinders 16*a* and 16*b* are actuated to push out the pressing shoe 23 and, at the end of this outward motion, the fluid ports of the sub-cylinders 16*a* and 16*b* are closed to prevent the backward motion of the pressing shoe 23. Then, the main hydraulic cylinder 13 is actuated to push out the side connecting pin 12 so that the outer part of the forward face 26 of the pressing shoe 23 will first come into contact with the entrance part of the oblique forward side wall 6 of the slot 5 and, then, the forward oblique face 26 will slide on the oblique forward side wall 6 while the connecting pin 12 is pushed out to insert the pressing shoe 23 into the slot 5. At the same time, the pusher boat 3 is pushed back at the rate corresponding to the slope of the oblique forward side wall 6 to form a proper clearance between the fender 41 and the deepest point of the notch 2. The outward motion of the side connecting pin 12 is stopped when the rearward face 27 of the pressing shoe 23 comes into contact with the oblique rearward side wall 7 of the slot 5 as shown in FIG. 9. At this stage, friction force between the pressing shoe 23 and the slot 5 prevents relative vertical slip of the pressing shoe 23 when the pressure in the main hydraulic cylinder 13 is maintained by the pump, pressure accumulator or the like, and, thus, the provisional connection by friction engagement is finished.

In the next stage of operation, the pressure in the hydraulic sub-cylinders 16*a* and 16*b* is released so that the friction between the pressing shoe 23 and the slot 5 vanishes and the pressing shoe 23 becomes slidable back under influence of an external force. At the same time, the main hydraulic cylinder 13 is actuated to extend the side connecting pin 12 so that the tip 19 at the outer end of the projection 18 will engage into one of the side concavities 9, 9', 9'', . . . which is at approximately the same height as the tip 19. Immediately after, the pressing shoe 23 is pushed out by the function of the hydraulic sub-cylinders 16*a* and 16*b* so that the pressing shoe 23 may be pressed onto the forward and rearward oblique side walls 6 and 7 of the slot 5 and, as the result of combined effects of the tightly pressed-on contact between the pressing shoe 23 and the slot 5 and the tooth-engagement between the tip 19 and one of the concavities 9, 9', 9'', . . . , a firm and reliable connection by means of the side connecting pins 12 is established a shown in FIG. 10.

Next to this, the bow connecting pin 37 is extended out by the function of the bow hydraulic cylinder 38 in order that the tip 37*a* may engage into one of the centerline concavities 35, 35', 35'', . . . which is at approximately the same height as the tip 37*a*. Then, the pressure in the bow hydraulic cylinder 38 is maintained by fluid pressure from the pump, pressure accumulator or the like (not shown in drawings) and, thus, connection of the pusher boat 3 and barge 1 is established as a combined function of the two side connecting pins 12 and the bow connecting pin 37. The combination of the pusher boat and the barge formed by the above-mentioned type of connection can assure a high seaworthiness not different from that of conventional single-hull ships.

Even when the pusher-barge combination is subjected to heavy vertical motions and pitching due to high waves, the projection 18 of the side connecting pin 12 has such a large vertical dimension as to maintain a sufficient strength against vertical loads to assure safe navigation in rough sea.

When the draft of the barge changes gradually due to loading and unloading of the barge in quiet harbors, the wave-excited loads the connecting means is subjected to are much smaller than those experienced in wavy sea and the provisional connection by friction-engagement is sufficient to assure a safe connection.

During loading and unloading of the barge, the gradual change of draft of the barge disturbs the equilibrium of draft between the pusher boat and the barge. Therefore, the main hydraulic cylinder 13 is actuated at a proper time interval to retract the side connecting pin 12 slightly so that friction between the pressing shoe 23 and the slot 5 will disappear and the pusher boat will drop down or float up to recover the equilibrium of draft. Then, the main hydraulic cylinder 13 is actuated again to extend the side connecting pin 12 for realizing a tight contact between the pressing shoe 23 and the slot 5 and, thus, the draft adjustment, or the "transition to connection in a new draft relationship", is finished. If the draft adjustment through loosening the connection as stated above is carried out at a pre-determined proper time interval, the two watercraft can always be kept connected in an approximate equilibrium and, accordingly, the pusher boat need not be disconnected from the barge and moored at another place during loading and unloading of the barge. Further the pusher boat is free from the inconvenience of unnecessary oscillation due to waves generated by other ships passing nearby while in port.

While only a preferred embodiment of this invention has been shown and described by way of illustrations, various modifications may occur to those skilled in the art and it is, therefore, desired that it be understood that it is intended in the appended claims to cover all such modifications as fall within the true spirit and scope of this invention.

What is claimed is:

1. Apparatus for connecting a pusher boat and a barge, wherein the barge has a hull receiving notch formed in its stern with a pair of vertically extending side slots formed at opposing positions in a peripheral wall of the hull receiving notch, and the pusher boat has a hull portion which is complementary in shape to the hull receiving notch, said apparatus comprising:

a pair of side connecting pins;

side pin mounting means for mounting said side connecting pins to the hull portion of the pusher boat such that said side connecting pins can slide between extended positions in which they are adapted to engage in the side slots formed in the peripheral wall of the hull receiving notch, and retracted positions;

side pin actuating means for moving said side connecting pins between their extended and retracted positions, respectively;

a pair of projection members fixedly mounted to and projecting from end faces of said side connecting pins, respectively;

a pair of pressing shoes mounted on said projection members, respectively, for movement between inner positions adjacent said end faces of said side connecting pins and outer positions spaced from said end faces of said side connecting pins, respectively; and pressing shoe actuating means for moving said pressing shoes to said outer positions, respectively.

2. An apparatus as recited in claim 1, further comprising a bow connecting pin;

bow pin engaging means, adapted to be mounted at a central position relative to the side slots on the peripheral wall of the hull receiving notch, for engaging a tip end of said bow connecting pin;

bow pin mounting means for mounting said bow connecting pin to the hull portion of the pusher boat such that said bow connecting pin can slide between an extended position in which it is adapted to engage with said bow pin engaging means, and a retracted position; and bow pin actuating means for moving said bow connecting pin between its extended and retracted positions.

3. An apparatus as recited in claim 2, further comprising side pin engaging means, adapted to be mounted in the side slots formed in the peripheral wall of the hull receiving notch, for engaging tip ends of said projection members, respectively, when said side connecting pins are in their respective extended positions.

4. An apparatus as recited in claim 3, wherein said side pin engaging means comprises a first engaging member adapted to be mounted in one of the side slots, and a second engaging member adapted to be mounted in the other of the side slots, and said bow pin connecting means comprises a third engaging member, each of said first, second, and third engaging members having a plurality of vertically aligned concavities of substantially equal cross section formed therein, respectively.

5. An apparatus as recited in claim 2, wherein said side pin mounting means comprises a pair of bearings within which said pair of side connecting pins are slidably mounted, respectively; and said bow pin mounting means comprises a bearing within which said bow connecting pin is slidably mounted.

6. An apparatus as recited in claim 2, wherein said side pin actuating means comprises at least one piston/cylinder operatively connected to said pair of side connecting pins; and said bow pin actuating means comprises at least one piston/cylinder operatively connected to said bow connecting pin.

7. An apparatus as recited in claim 2, wherein said pressing shoe actuating means comprises at least one piston/cylinder mounted to one of said side connecting pins, and at least one piston/cylinder mounted to the other of said side connecting pins.

8. An apparatus as recited in claim 2, wherein said projection members and said bow connecting pin have free ends which are substantially wedge-shaped, respectively.

9. An apparatus as recited in claim 1, further comprising side pin engaging means, adapted to be mounted in the side slots formed in the peripheral wall of the hull receiving notch, for engaging tip ends of said projection members, respectively, when said side connecting pins are in their extended positions.

10. An apparatus as recited in claim 1, wherein said side pin engaging means comprises a first engaging member adapted to be mounted in one of the side slots, and a second engaging member adapted to be mounted in the other of the side slots, each of said first and second engaging members having a plurality of vertically aligned concavities of equal cross section formed therein, respectively.

11. An apparatus as recited in claim 1, wherein said side pin mounting means comprises a pair of bearings within which said pair of side connecting pins are slidably mounted, respectively.

12. An apparatus as recited in claim 1, wherein said side pin actuating means comprises at least one piston/cylinder operatively connected to said pair of side connecting pins.

13. An apparatus as recited in claim 1, wherein said pressing shoe actuating means comprises at least one piston/cylinder mounted to one of said side connecting pins, and at least one piston/cylinder mounted to other of said side connecting pins.

14. An apparatus as recited in claim 1, wherein said projection members have free ends which are substantially wedge-shaped, respectively.

15. An apparatus as recited in claim 1, wherein said pressing shoes are substantially trapezoidal in cross section and are covered with a high friction material such that they are adapted to frictionally engage in the side slots formed in the peripheral wall of the hull receiving notch.

16. An apparatus as recited in claim 15, wherein said high friction material is rubber or resin.

17. An apparatus as recited in claim 1, wherein each of said pressing shoes has a hole formed therethrough, and at least one pin extending at least partially across said hole; and said projection members extend through said holes, respectively, and each of said projection members has at least one slot formed therein for slidably receiving said at least one pin, respectively.

18. A combination comprising:

a barge having a hull receiving notch formed in its stern with a pair of vertically extending side slots formed at opposing positions in a peripheral wall of said hull receiving notch;

a pusher boat having a hull portion which is complementary in shape to said hull receiving notch;

a pair of side connecting pins;

side pin mounting means for mounting said side connecting pins to said hull portion of said pusher boat such that said side connecting pins can slide between extended positions in which they are adapted to engage in said side slots formed in said peripheral wall of said hull receiving notch, and retracted positions;

side pin actuating means for moving said side connecting pins between their extended and retracted positions, respectively;

a pair of projection members fixedly mounted to and projecting from end faces of said side connecting pins, respectively;

a pair of pressing shoes mounted on said projection members, respectively, for movement between inner positions adjacent said end faces of said side connecting pins and outer positions spaced from said end faces of said side connecting pins, respectively; and pressing shoe actuating means for moving said pressing shoes to said outer positions, respectively.

19. An apparatus as recited in claim 18, further comprising a bow connecting pin;

bow pin engaging means mounted at a central position relative to said side slots on said peripheral wall of said hull receiving notch;

bow pin mounting means for mounting said bow connecting pin to said hull portion of said pusher boat such that said bow connecting pin can slide between an extended position in which it is adapted to engage with said bow pin engaging means, and a retracted position; and bow pin actuating means for moving said bow connecting pin between its extended and retracted positions.

20. An apparatus as recited in claim 19, further comprising side pin engaging means, mounted in said side slots formed in said peripheral wall of said hull receiving notch, for engaging tip ends of said projection members, respectively, when said side connecting pins are in their respective extended positions.

21. An apparatus as recited in claim 20, wherein said side pin engaging means comprises a first engaging member mounted in one of said side slots, and a second engaging member mounted in the other of said side slots, and said bow pin engaging means comprises a third engaging member, each of said first, second, and third engaging members having a plurality of vertically aligned concavities of substantially equal cross section formed therein, respectively.

22. An apparatus as recited in claim 19, wherein said side pin actuating means comprises at least one piston/cylinder operatively connected to said pair of side connecting pins; and said bow pin actuating means comprises at least one piston/cylinder operatively connected to said bow connecting pin.

23. An apparatus as recited in claim 19, wherein said hull portion of said pusher boat comprises a bow portion of said pusher boat.

* * * * *